US008511800B2

(12) United States Patent
Seki et al.

(10) Patent No.: US 8,511,800 B2
(45) Date of Patent: Aug. 20, 2013

(54) MANUFACTURING METHOD OF INKJET HEAD AND INKJET HEAD

(75) Inventors: Masashi Seki, Shizuoka-ken (JP); Masashi Shimosato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/236,596

(22) Filed: Sep. 19, 2011

(65) Prior Publication Data

US 2012/0133709 A1 May 31, 2012

(30) Foreign Application Priority Data

Nov. 30, 2010 (JP) ..... 2010-266648

(51) Int. Cl.
*B41J 2/045* (2006.01)
*B41J 2/04* (2006.01)
*B41J 2/05* (2006.01)

(52) U.S. Cl.
USPC ..... 347/69; 347/54; 347/64

(58) Field of Classification Search
None
See application file for complete search history.

(56) References Cited

U.S. PATENT DOCUMENTS 5,475,407 A * 12/1995 Ohashi ..... 347/69
2005/0210645 A1* 9/2005 Xin-Shan et al. ..... 29/25.35

FOREIGN PATENT DOCUMENTS

| | | |
|---|---|---|
| JP | 06-008450 | 1/1994 |
| JP | 06-246913 | 9/1994 |
| JP | 09-109392 | 4/1997 |
| JP | 2002-029061 A | 1/2002 |
| JP | 2003-266706 | 9/2003 |
| JP | 2006-321123 | 11/2006 |
| JP | 2007-253582 A | 10/2007 |
| JP | 2009-233927 | 10/2009 |

OTHER PUBLICATIONS

Japanese Application No. 2010-266648 Office Action (Jan. 22, 2013) (English translation submitted).

* cited by examiner

*Primary Examiner* — Geoffrey Mruk
(74) *Attorney, Agent, or Firm* — Patterson & Sheridan, L.L.P.

(57) ABSTRACT

According to one embodiment, when an electrode protection film of an inorganic material, which is apt to form a pin hole by influence of roughness of a ground, is used, an electrode as a smoothed electrode is formed on the ground of the electrode protection film by a plating method, or a film is formed as a smoothed layer (film) by an inorganic coating material such as SIRAGUSITAL (trade name: New Technology Creating Institute Co., Ltd.), such that the thickness of the electrode protection film is 1.0 μm or more, and the average surface roughness of the ground of the electrode protection film is 0.6 μm or less.

3 Claims, 6 Drawing Sheets

MANUFACTURING METHOD OF INKJET HEAD AND INKJET HEAD

CROSS-REFERENCE TO RELATED APPLICATION

This application is based upon and claims the benefit of priority from: Japanese Patent application No. 2010-266648, filed on Nov. 30, 2010; the entire contents of each of which are incorporated herein by reference.

FIELD

Embodiments described herein relate generally to a technique of an inkjet head including a protection film on an electrode.

BACKGROUND

In an inkjet recording apparatus, a so-called shear mode type inkjet head is proposed in which an ink droplet is ejected from a nozzle hole by using shear mode deformation of a piezoelectric member.

The inkjet head includes a base substrate in which plural groove parts are formed into ink chambers. A nozzle plate including nozzle holes facing the respective groove parts of the base substrate is bonded to the end face of the base substrate. An electrode to apply power to the piezoelectric member is formed on the inner wall surface of the ink chamber which the nozzle hole faces. An organic protection film against ink, in which a poly-chloro-para-xylylene film and a poly-para-xylylene film are laminated in this order, is formed on the surface of the electrode.

As stated above, since the poly-chloro-para-xylylene film is formed as a smooth ground film for the poly-para-xylylene film which is apt to form a pin hole by influence of roughness of a ground, the poly-para-xylylene film having no pin hole and having high reliability is formed.

After the nozzle plate is bonded to the base substrate, when a nozzle is formed in the nozzle plate by laser beam, the nozzle hole is formed into a truncated cone shape. At that time, the protection film on the inner wall surface of the ink chamber may be exposed to the laser beam, and the protection film may be damaged. Thus, when liquid having electrical conductivity is used as ink, there is a fear that the print quality of the inkjet head and the durability can not be maintained.

DETAILED DESCRIPTION

In general, according to one embodiment, a manufacturing method of an inkjet head comprises forming an electrode part, in which an electrode protection film of an inorganic material is formed as a surface layer, on an inner surface of a groove part formed in a substrate of the inkjet head, bonding a nozzle plate to an opening end face of a pressure chamber in the groove part by an adhesive after the electrode part is formed, and forming, in the nozzle plate, a nozzle communicating with the pressure chamber by laser machining after the nozzle plate is bonded.

In the formation of the electrode part, a smoothed electrode having an average surface roughness of 0.6 μm or less is formed on the inner surface of the groove part, and the electrode protection film having a thickness of 1.0 μm or more is formed on a surface of the smoothed electrode.

First Embodiment

Figure 1:
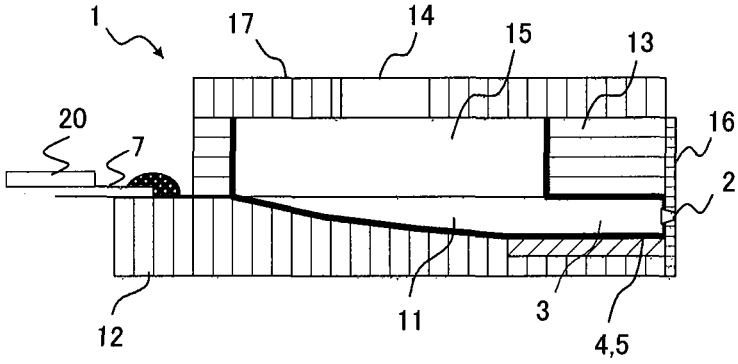
FIG. 1 is a vertical sectional view showing a first embodiment in a direction perpendicular to a nozzle line direction of an inkjet head.
Figure 2:
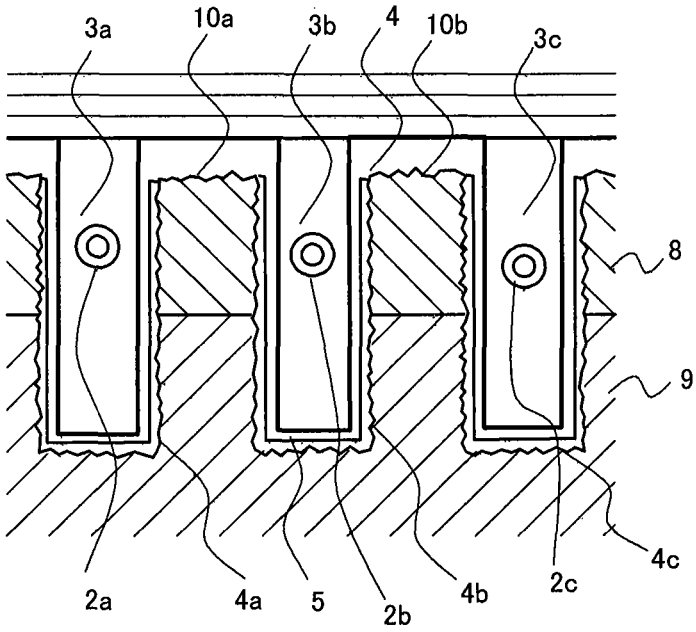
FIG. 2 is a vertical sectional view showing the first embodiment in a direction along the nozzle line direction of the inkjet head.

FIG. 1 and FIG. 2 show a first embodiment. FIG. 1 is a vertical sectional view in a short side direction perpendicular to a nozzle line direction in which many nozzles are formed in an inkjet head 1, and FIG. 2 is a vertical sectional view in a longitudinal direction along the nozzle line direction.

A description will be made on an inkjet head structure and operation when an electrode (hereinafter referred to as a smoothed electrode) which is smoothed is used as a ground of an electrode protection film in the inkjet head of the embodiment.

The inkjet head 1 includes a substrate 12, a top plate frame 13, a top plate cover 17 and a nozzle plate 16. Many nozzles 2 are formed in the nozzle plate 16 in a front and back direction of the paper surface of FIG. 1, and a direction in which the nozzles 2 are formed in a line is referred to as a nozzle line direction. Plural long groove parts 11 are formed in the substrate 12 in parallel along the nozzle line direction. A smoothed electrode 4 is electrically independently formed on an inner surface of each of the long groove parts 11, and is connected to a flexible cable 7 through an upper surface of the substrate 12. The flexible cable 7 is connected to a drive circuit 20 to generate a drive pulse to drive the inkjet head 1.

An electrode protection film 5 made of an inorganic material is formed on the surface of the smoothed electrode 4.

Each of the long groove parts 11 is sealed with the top plate frame 13, and a portion surrounded by the long groove part 11 and the top plate frame 13 forms a pressure chamber 3. The adjacent pressure chambers 3 are separated through a side wall 10 including piezoelectric members 8 and 9. The side wall 10 (10*a*, 10*b*, . . . ) is constructed such that the piezoelectric members 8 and 9 polarized in directions opposite to each other are arranged up and down, and operates as an actuator which is deformed in a shear mode by the drive pulse applied to the smoothed electrode 4.

The nozzle plate 16 is provided at the ends of the pressure chambers 3, and each of the pressure chambers 3 communicates with the outside through the nozzle 2 formed in the nozzle plate 16. Ink is supplied from an ink supply port 14 formed in the top plate cover 17 and in order of a common pressure chamber 15, the long groove part 11, the pressure chamber 3 (3*a*, 3*b*, 3*c* . . . ), and the nozzle 2 (2*a*, 2*b*, 2*c* . . . ). When the drive pulse is supplied from the drive circuit 20, a potential difference occurs between a smoothed electrode 4*a*, 4*c* and a smoothed electrode 4*b*, and an electric field is generated in a side wall 10*a*, 10*b*. The side wall 10*a*, 10*b* is deformed in the shear mode by this electric field, so that a pressure variation occurs in the ink in the pressure chamber 3*b*, and the ink is ejected from the nozzle 2*b*. Even when the ink having electrical conductivity is used, the ink and the smoothed electrode 4 are electrically insulated by the electrode protection film 5. Accordingly, corrosion of the smoothed electrode 4 due to the flow of an electric current in the ink, electrolysis of the ink, aggregation of a dispersion element in the ink, such as a pigment, and the like can be prevented.

As the substrate 12, alumina ($Al_2O_3$), silicon nitride ($Si_3N_4$), silicon carbide (SiC), aluminum nitride (AlN), lead zirconate titanate (PZT) or the like can be used. In this embodiment, in view of a difference in expansion coefficient from the piezoelectric member 8, 9 and dielectric constant, PZT having a low dielectric constant is used. The piezoelectric member 8, 9 is made of lead zirconate titanate (PZT:Pb $(Zr,Ti)O_3$), lithium niobate ($LiNbO_3$), lithium tantalate ($LiTaO_3$) or the like. In this embodiment, PZT having a high piezoelectric constant is used.

The smoothed electrode 4 includes two-layer films of copper (Cu) and Nickel (Ni). In order to uniformly form the smoothed electrode 4 also in the inside of the long groove part 11, the electrode is formed by plating. Specifically, masking necessary for forming the smoothed electrode in each of the long groove parts 11 is performed, and plating is performed. The long groove parts 11 are each shaped to have a depth of 300 μm and a width of 80 μm, and are arranged in parallel along a nozzle row at a pitch of 169 μm.

The nozzle plate 16 is a polyimide film having a thickness of 50 μm, and the truncated cone shaped nozzles 2 the number of which corresponds to the number of the long grooves are formed by an excimer laser apparatus. The shape of the nozzle 2 is such that the opening diameter at the ejection side is 30 μm and the opening diameter at the pressure chamber side is 50 μm, and is the truncated cone shape (inverse tapered shape) narrowing to the ejection side. The nozzle 2 (2*a*, 2*b*, 2*c* . . . ) formed in the nozzle plate 16 is formed closer to the top plate frame side than the center part of the long groove part 11 in the depth direction.

The ratio (depth/width) of the depth to the width of the long groove part 11 is called an aspect ratio. That is, as the depth of the long groove part 11 becomes deep and the width becomes narrow, the aspect ratio becomes high.

A manufacturing method of the inkjet head 1 of the first embodiment will be described with reference to FIG. 3.

Figure 3:
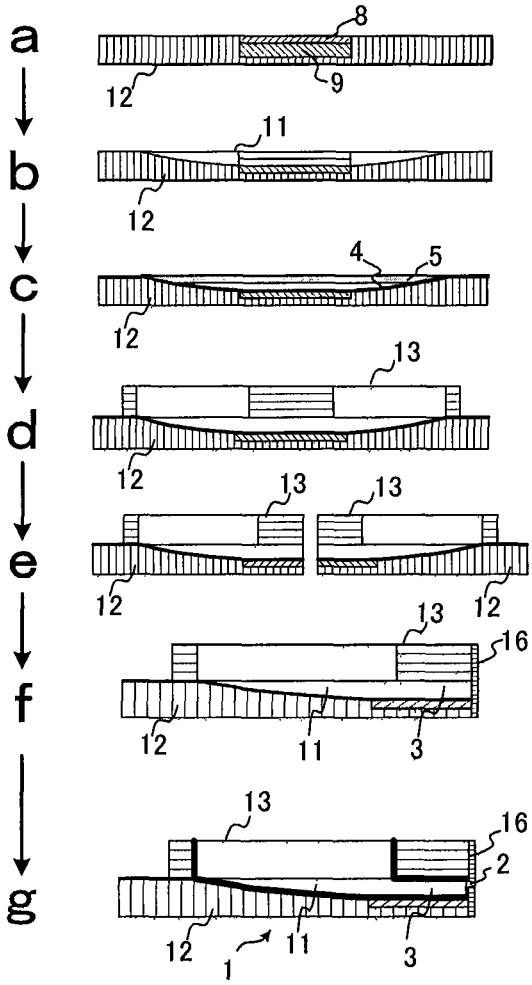
FIG. 3 is a vertical sectional view showing processes of a manufacturing method of the first embodiment.

FIG. 3 is a sectional view showing manufacturing processes of the inkjet head 1 of the embodiment, and the manufacturing processes advance in sequence of process a to process g. The process a represents a preparation process of the substrate 12, at which the two piezoelectric members 8 and 9 (PZT) polarized in the thickness direction are bonded so that the polarization directions are opposite to each other, and the members are buried in the substrate 12 and are bonded. As the material of the substrate 12, PZT having a low dielectric constant as compared with the piezoelectric members 8 and 9 is used as described before.

Process b represents a formation process of the long groove part 11, at which the plural long grooves 11 are formed in the substrate 12 prepared at the process a at regular intervals along the nozzle line direction and in the direction parallel to the end face of the substrate 12 and crossing the piezoelectric members 8 and 9 by cutting work using a diamond cutter. Specifically, the tooth width of the diamond cutter is 80 μm, and the width of the long groove is also 80 μm. The depth of the long groove part 11 is determined by the feed amount of the diamond cutter tooth in the depth direction, and is 300 μm. The long groove interval is formed at a pitch of 169 μm. The aspect ratio is 300/80 and is 3.75. The aspect ratio and the interval between the long groove parts 11 are specific values based on the resolution and the ink ejection amount required for the inkjet head.

Process c represents a film forming process of the smoothed electrode 4 and the inorganic insulation film 5 constituting the electrode part. An electrode pattern is formed on the surface of the substrate 12 and the inner surfaces of the long groove parts 11 by electroless Cu plating (electroless copper plating) and electrolytic Cu plating (electrolytic copper plating). Further, electrolytic Ni plating (electrolytic nickel plating) is performed on the Cu electrode, and a smoothing process is performed so that the average surface roughness of the Cu electrode becomes 0.6 μm or less. Next, as the electrode protection film 5 made of an inorganic insulating material, an $SiO_2$ film having a thickness of 1.0 μm or more is formed in the long groove part 11.

The $SiO_2$ film is formed to have a thickness of 1.0 μm or more by a PE-CVD method (Plasma enhanced chemical vapor deposition). Incidentally, at the time of film formation, a part of the electrode 4 extended to the upper surface of the substrate 12 is masked, so that the $SiO_2$ film is not formed on a connection portion between the flexible cable 7 and the electrode 4.

As the inorganic insulating material of the electrode protection film 5, $Al_2O_3$, SiN, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, AlN, $Fe_3O_4$ or the like can be used.

As the film formation method, an MBE (molecular beam epitaxy) method, an AP-CVD (atmospheric pressure chemical vapor deposition) method, an ALD (atomic layer deposition) method, a coating method or the like can be used in addition to the PE-CVD method. In other words, any method may be used as long as the foregoing inorganic insulating material including $SiO_2$ can be deposited on the Ni electrode in vacuum or atmosphere by performing a chemical reaction or condensation.

Process d represents a bonding process of the top plate frame 13. The top plate frame 13 is bonded to the upper surface of the substrate 12.

Process e represents a process to cut the member shown at process d at a half position in the right-and-left direction. The substrate 12 is divided into two inkjet heads 1 by the cutting work.

Process f represents a bonding process of a polyimide film. The polyimide film which becomes the nozzle plate 16 is bonded to the side surface of the pressure chamber 3. When the polyimide film is bonded to the side surface of the pressure chamber 3, an adhesive existing between the side wall 10 and the polyimide film protrudes into the pressure chamber 3 since the polyimide film is pressed to the side wall 10. The protruding adhesive becomes a thin film at the pressure chamber side of the polyimide film and is hardened. An epoxy adhesive is used as the adhesive.

Process g represents a formation process of the nozzle 2. The inverse tapered nozzle is formed in the polyimide by an excimer laser. The truncated cone shape (inverse tapered shape) of the nozzle 2 is such that the opening diameter at the pressure chamber 3 side is larger than the opening diameter at the ink ejection side. The position of the nozzle machined by the excimer laser is closer to the opening side than the center of the pressure chamber 3. The excimer laser is irradiated to the polyimide film from the side opposite to the pressure chamber 3 across the nozzle plate 16 of the polyimide film, and the polyimide is chemically decomposed so that the nozzle 2 is formed. The focal position of the excimer laser is shifted from the polyimide film, so that the laser beam spreads, and accordingly, the inverse tapered shape is formed in which the ejection port side is narrow and the pressure chamber side is wide.

Figure 4A:
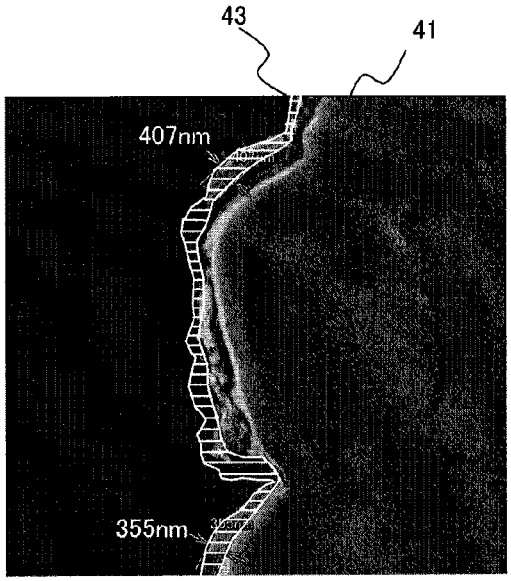
FIG. 4A is a cross-sectional view of an electrode without a smoothed electrode.
Figure 4B:
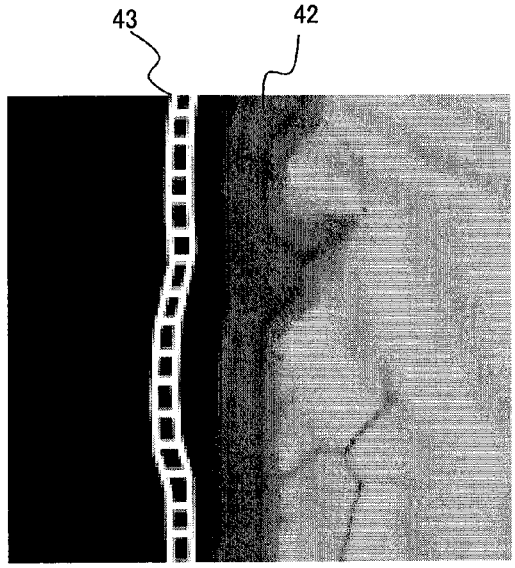
FIG. 4B is a cross-sectional view of a smoothed electrode in the first embodiment.

FIG. 4A shows an observation result of an electrode protection film 43 when an electrode 41 without a smoothed electrode is used, and FIG. 4B shows an observation result of an electrode protection film 43 when a smoothed electrode 42 is used. The electrode protection film 43 as the inorganic insulating film is formed to have a thickness of 1 μm or less by the PE-CVD method.

The electrode 41 without the smoothed electrode shown in FIG. 4A has a large surface roughness, and an average surface roughness (Ra) is 1.7 μm. Since the average surface roughness is large, the thickness of the electrode protection film 43 at a protrusion is different from the thickness at a recess (407 nm, 355 nm), and especially, the thickness of the electrode protection film 43 at the recess is thin. There is a high possibility that the thin place causes a pin hole.

On the other hand, when the smoothed electrode 42 shown in FIG. 4B is used, as compared with FIG. 4A, the roughness of the surface of the smoothed electrode 42 is small, and the average surface roughness is 0.6 μm. Since the average surface roughness is small, the thickness of the electrode protection film 43 becomes uniform, and a locally thin place does not exist. Thus, there is a low possibility that a pin hole is formed.

Table 1 shows the results of measuring the number of pin holes of the electrode protection film formed while changing the average surface roughness of the ground substrate of the electrode protection film, and the thickness of the electrode protection film. The substrate in which the average surface roughness of the ground substrate of the electrode protection film is 1.7 μm is a related art substrate not subjected to the smoothing process. Besides, the substrate in which the average surface roughness of the ground substrate of the electrode protection film is 0.6 μm is a substrate subjected to the smoothing process and described in the embodiment.

In comparative examples 1 to 4 in which the average surface roughness of the ground substrate of the electrode protection film is 1.7 μm, when the thickness of the electrode protection film is 1.0 μm or less, there are many pin holes, and the insulation between the electrode and the ink can not be ensured.

In comparative examples 5 to 7 and example 1 in which the average surface roughness of the ground substrate of the electrode protection film is 0.6 in comparative example 7 in which the thickness of the electrode protection film is 0.8 μm, the number of pin holes becomes several, and when the thickness of the electrode protection film is 1.0 μm, there is no pin hole (the number of pin holes is 0). Thus, the insulation between the electrode and the ink can be ensured.

When the smoothing process of the embodiment is performed, and the average surface roughness of the ground substrate of the electrode protection film is made 0.6 μm, when the thickness of the electrode protection film is 1.0 μm or more, the electrode protection film without pin hole can be formed.

That is, in this embodiment, the inorganic material which is apt to form a pin hole by the influence of the ground roughness is used for the electrode protection film 5 constituting the electrode part. Then, when the average surface roughness of the ground of the electrode protection film 5 is made 0.6 μm or less, and the thickness of the electrode protection film 5 is made 1.0 μm or more, the electrode protection film without pin hole is formed.

TABLE 1

| | Presence or absence of smoothing process | Average surface roughness [μm] | Thickness of electrode protection film [μm] | Number of pin holes |
|---|---|---|---|---|
| Comparative example 1 | absence | 1.7 | 0.2 | many |
| Comparative example 2 | absence | 1.7 | 0.5 | many |
| Comparative example 3 | absence | 1.7 | 0.8 | many |
| Comparative example 4 | absence | 1.7 | 1.0 | many |
| Comparative example 5 | presence | 0.6 | 0.2 | many |
| Comparative example 6 | presence | 0.6 | 0.5 | many |
| Comparative example 7 | presence | 0.6 | 0.8 | several |
| Example 1 | presence | 0.6 | 1.0 | 0 |

A method of laser machining of a nozzle hole in the substrate on which the electrode protection film without pin hole is uniformly formed on the whole groove will be described with reference to FIG. 5.

Figure 5:
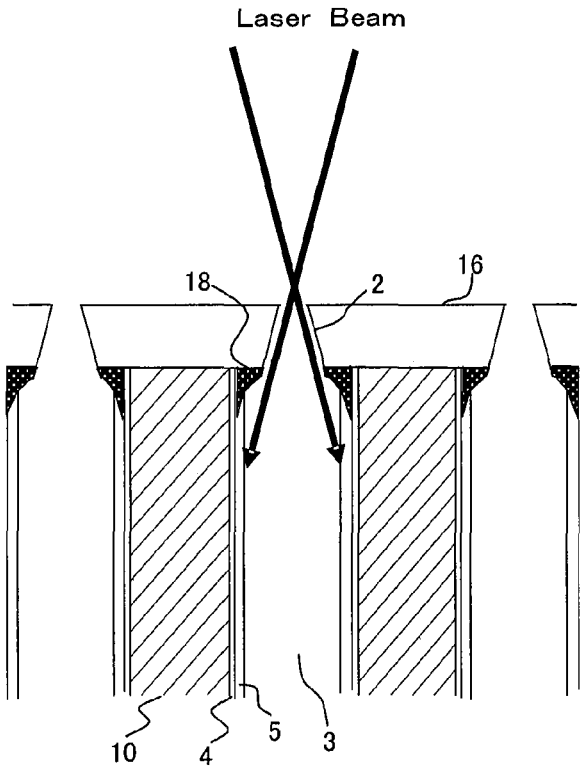
FIG. 5 is a cross-sectional view of a laser beam incident on an electrode protection film in the first embodiment.

FIG. 5 is a detailed sectional view of the periphery of the nozzle 2 when the nozzle 2 is formed by the excimer laser and by performing hole machining of the truncated cone shape (inverse tapered shape) in the nozzle plate 16 made of the polyimide film.

When the nozzle plate 16 made of the polyimide film is bonded to the side surface of the pressure chamber 3, the protruding adhesive 18 is removed at the time of formation of the nozzle 2 by the excimer laser. Since a laser irradiation part in the pressure chamber 3 is provided with the electrode protection film 5 of the inorganic material, even if the laser beam is irradiated, the electrode protection film 5 is not damaged by the laser.

Since the electrode protection film 5 suppresses the laser damage, and the insulation of the smoothed electrode 4 is kept, even when conductive aqueous ink is injected into the pressure chamber 3, the electrical insulation between the smoothed electrode 4 and the ink is kept. Thus, the corrosion of the smoothed electrode 4 and the electrolysis of the ink can be prevented.

Figure 6:
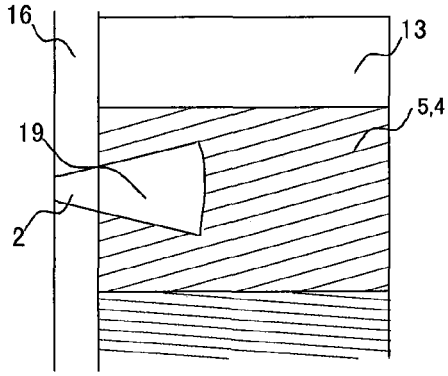
FIG. 6 is a vertical sectional view of the laser beam incident on the electrode protection film in the first embodiment.

FIG. 6 shows a state of a place (laser irradiation place) 19 of the inkjet head including the electrode protection film 5 of the inorganic material, to which the laser is irradiated. The excimer laser beam passes through the nozzle plate 16 and forms the nozzle 2. After the excimer laser beam forms the nozzle 2, the laser beam is irradiated onto the electrode protection film 5 formed on the surface of the smoothed electrode 4 provided on the inner wall of the pressure chamber 3. The laser irradiation place 19 is close to the nozzle on the electrode protection film 5. Since the excimer laser beam is incident on the pressure chamber 3 from the nozzle plate side, the laser irradiation place is formed in the ink ejection direction of the pressure chamber 3. The size of the laser irradiation place is changed according to the intensity of the excimer laser beam and the taper angle of the nozzle.

Although not shown, it is confirmed by SEM (Scanning Electron Microscope) observation and EDX (Energy dispersive X-ray spectrometry) that the electrode protection film 5 is not actually damaged by the laser irradiation to the electrode protection film 5.

Second Embodiment

Figure 7:
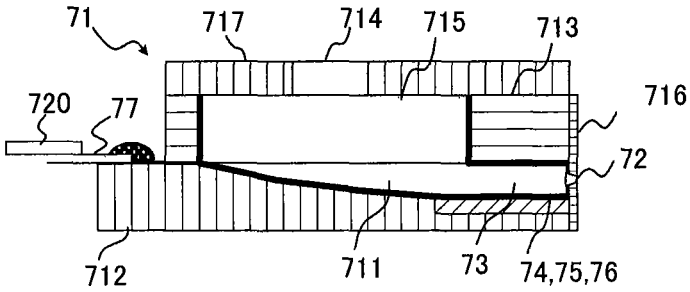
FIG. 7 is a vertical sectional view showing a second embodiment in a direction perpendicular to a nozzle line direction of an inkjet head.
Figure 8:
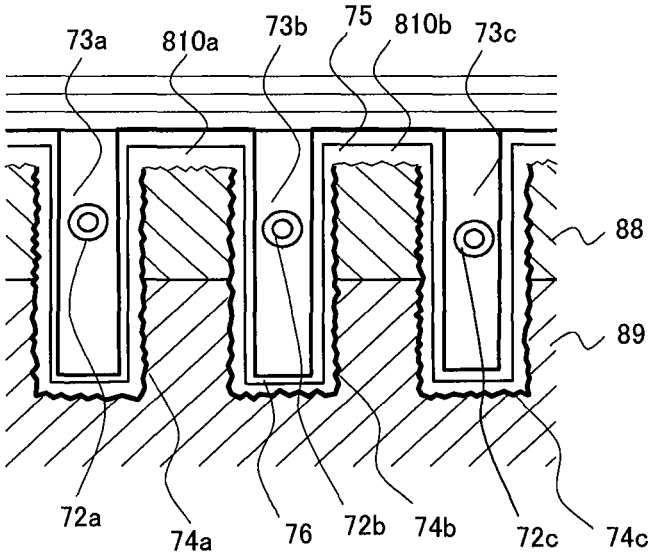
FIG. 8 is a vertical sectional view shows the second embodiment in a direction along the nozzle line direction of the inkjet head.

FIG. 7 and FIG. 8 are sectional views of an inkjet head of a second embodiment. In this embodiment, the basic structure is the same as the inkjet head of the first embodiment, and a structure and an operation of the inkjet head when a smoothed film is formed on an electrode will be described.

An inkjet head 71 includes a substrate 712, a top plate frame 713, a top plate cover 717 and a nozzle plate 716.

Plural long groove parts 711 are formed in the substrate 712 in parallel along a nozzle line direction. An electrode 74 is formed electrically independently on the inner surface of each of the long groove parts 711, and the independent electrode is connected to a flexible cable 77 through the upper surface of the substrate 712. The flexible cable 77 is connected to a drive circuit 720 to generate a drive pulse to drive the inkjet head 71.

A smoothed film 75 made of an inorganic material, and an electrode protection film 76 made of an inorganic material are sequentially formed on the surface of the electrode 74. That is, the electrode part of this embodiment includes the electrode 74, the smoothed film 75 formed on the surface of the electrode 74, and the electrode protection film 76 formed on the surface of the smoothed film 75.

Each of the long groove parts 711 is sealed with the top plate frame 713, and a portion surrounded by the long groove part 711 and the top plate frame 713 forms a pressure chamber 73. As shown in FIG. 8, the adjacent pressure chambers 73 are separated through a side wall 810 including piezoelectric members 88 and 89 arranged up and down. The side wall 810 (810*a*, 810*b*) includes the piezoelectric members 88 and 89 polarized in directions opposite to each other, and acts as an actuator deformed in a shear mode by the drive pulse applied to the electrode 74 (74*a*, 74*b*, 74*c*).

The nozzle plate 716 is provided at the end of the pressure chamber 73, and the pressure chamber 73 (73*a*, 73*b*, 73*c*) communicates with the outside through a nozzle 72 formed in the nozzle plate 716. Ink is supplied from an ink supply port 714 formed in the top plate cover 717 and in order of a common pressure chamber 715, the long groove part 711, the pressure chamber 73 and the nozzle 72 (72*a*, 72*b*, 72*c*).

When the drive pulse is supplied from the drive circuit 720, a potential difference occurs between an electrode 74*a*, 74*c* and an electrode 74*b*, and an electric field is generated in a side wall 810*a*, 810*b*. The side wall 810*a*, 810*b* is deformed in the shear mode by this electric field, so that a pressure variation occurs in ink in a pressure chamber 73*b*, and the ink is ejected from a nozzle 72*b*. Even when the ink having electrical conductivity is used, electrical insulation is achieved by the electrode protection film 76 between the ink and the electrode 74. Accordingly, corrosion of the electrode 74 due to the flow of electric current through the ink, electrolysis of the ink, aggregation of a dispersion element in the ink, such as a pigment, and the like are prevented.

As the substrate 12, alumina ($Al_2O_3$), silicon nitride ($Si_3N_4$), silicon carbide (SiC), aluminum nitride (AlN), lead zirconate titanate (PZT) or the like can be used. In view of a difference in expansion coefficient from the piezoelectric members 88 and 89 arranged up and down and dielectric constant, PZT having a low dielectric constant is used. Further, the piezoelectric members 88 and 89 arranged up and down are made of lead zirconate titanate (PZT:$Pb(Zr,Ti)O_3$), lithiumniobate ($LiNbO_3$), lithium tantalate ($LiTaO_3$) or the like. In this embodiment, PZT having a high piezoelectric constant is used.

The electrode 74 includes two-layer films of Nickel (Ni) and gold (Au). In order to uniformly form the electrode 74 also in the inside of the long groove part 711, the electrode is formed by plating. Specifically, masking necessary for forming the electrode in each of the long groove parts 711 is performed, and plating is performed. Sputtering or vacuum evaporation can also be used as the formation method of the electrode 74. The long groove parts 711 are each shaped to have a depth of 400 μm and a width of 80 μm, and are arranged in parallel at a pitch of 169 μm.

The nozzle plate 716 is a polyimide film having a thickness of 50 μm, and the nozzles 2 the number of which corresponds to the number of the long grooves are formed by an excimer laser apparatus. The shape of the nozzle 2 is such that the opening diameter at the ejection side is 30 μm and the opening diameter at the pressure chamber side is 50 μm, and is a truncated cone shape (inverse tapered shape) narrowing to the ejection side. The nozzle 72 formed in the nozzle plate 716 is formed closer to the top plate frame 713 than the center part of the long groove part 711 in the depth direction.

A manufacturing method of the inkjet head 71 of the second embodiment is different from the manufacturing method of the inkjet head 1 of the first embodiment in an electrode forming method and a pre-treatment of electrode protection film formation. The manufacturing method of the inkjet head of this embodiment will be described below with reference to FIG. 9. Incidentally, since processes a, b, d, e, f and g shown in FIG. 9 are the same as processes a, b, d, e, f and g shown in FIG. 3, their description is omitted.

Figure 9:
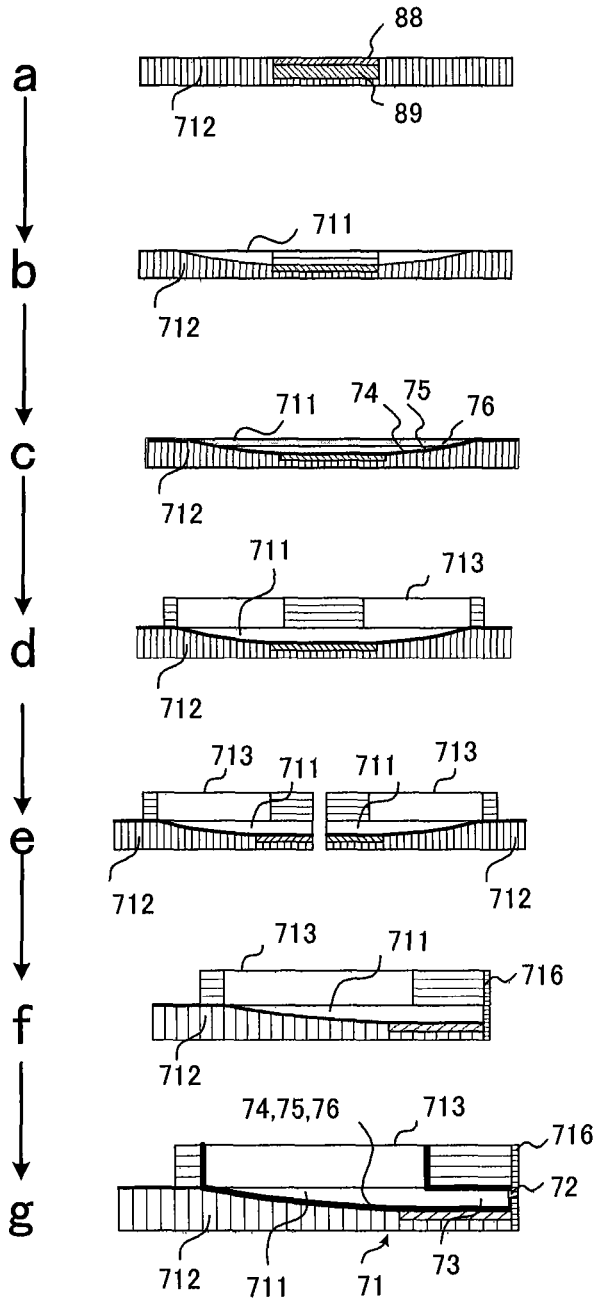
FIG. 9 is a vertical sectional view showing processes of a manufacturing method of the second embodiment.

Process c shown in FIG. 9 represents a formation process of the electrode 74, the smoothed film 75 and the inorganic insulating film 76. An electrode pattern is formed on the surface of the substrate 712 and the inner surface of the long groove part 711 by electroless Ni plating (electroless nickel plating) and electrolytic Au plating (electrolytic gold plating), and further, the smoothed film 75 is formed on the Au electrode.

Next, as the electrode protection film 76 made of an inorganic insulating material, a $SiO_2$ film is formed to have a thickness of 1.0 μm or more in the long groove part 711.

The smoothed film 75 is formed by a coating method using, for example, SIRAGUSITAL (trade name: New Technology Creating Institute Co., Ltd.), and a hard glass film is formed. Since the smoothed film 75 is required to be a film having an average surface roughness of 0.6 μm or less, the film thickness varies according to the kind of coating liquid.

A film of $SiO_2$ as the electrode protection film 76 is formed to have a thickness of 1.0 μm or more by a PE-CVD method (Plasma-enhanced chemical vapor deposition). Incidentally, a part of the electrode 74 extended to the upper surface of the substrate 712 is masked at the time of film formation, so that the $SiO_2$ film is not formed in a connection portion between the flexible cable 77 and the electrode 74.

As a coating material of the smoothed film 75, a coating solvent obtained by dissolving nano-silica or the like in an organic solvent can be used. As the film formation method of the smoothed film, a sol-gel method, a spray method, an electrodeposition method or the like can be used in addition to the coating method. In other words, any method may be used as long as a coating liquid can be attached to the whole groove and can be hardened.

As the inorganic insulating material of the electrode protection film 76, $Al_2O_3$, SiN, ZnO, MgO, $ZrO_2$, $Ta_2O_5$, $Cr_2O_3$, $TiO_2$, $Y_2O_3$, YBCO, mullite ($Al_2O_3.SiO_2$), $SrTiO_3$, $Si_3N_4$, ZrN, AlN, $Fe_3O_4$ or the like can be used.

As the film formation method, an MBE (molecular beam epitaxy) method, an AP-CVD (atmospheric pressure chemical vapor deposition) method, an ALD (atomic layer deposition) method, a coating method or the like can be used in addition to the PE-CVD method. In other words, any method may be used as long as the foregoing inorganic insulating material including $SiO_2$ can be deposited on the Ni electrode in vacuum or atmosphere by performing a chemical reaction or condensation.

Incidentally, the smoothed film 75 is formed on the surface of the smoothed electrode 4 of the first embodiment, and the electrode protection film 5 may be formed on the surface.

As described above, according to the above respective embodiments, since the nozzle is formed by the laser machining after the nozzle plate is bonded, the adhesive protruding at the time of bonding of the nozzle plate is removed by the laser beam at the time of nozzle machining. Thus, deterioration of print quality due to the protrusion of the adhesive to the nozzle hole can be prevented. Besides, in the laser machining, even when the laser beam is irradiated to the electrode protection film immediately after the nozzle is opened, since the smoothed electrode made of the metal material or the smoothed film made of the inorganic material, and the electrode protection film made of the inorganic material exist, damage to the electrode or PZT can be prevented, and the insulation between the ink and the electrode can be kept. Since the electrode protection film is made of the inorganic material, when the surface roughness of the ground is high, it is difficult to completely prevent the occurrence of a pin hole. However, since the smoothed electrode or the smoothed film is provided, the surface roughness of the ground is reduced, and the occurrence of a pin hole can be prevented. Thus, even when the liquid having electrical conductivity is used as the ink, dissolution of the electrode can be prevented, and durability of the inkjet head can be kept. That is, according to the embodiment, in the inkjet head of the structure in which the nozzle is formed by laser machining, and the smoothed electrode or the smoothed film and the electrode protection film are provided on the inner surface of the pressure chamber, the inkjet head can be provided in which both the print quality and the durability to the electrically conductive ink are satisfied.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An inkjet head comprising:

a substrate in which a plurality of groove parts are provided in parallel, open end sides of the respective groove parts communicating with pressure chambers;

a nozzle plate which is bonded to open end faces of the pressure chambers by an adhesive, and includes nozzles for ejecting ink, each communicating with a respective one of the pressure chambers;

a pressure generating unit configured to generate pressure in the pressure chambers to eject the ink through the nozzles;

an ink supply unit configured to supply the ink into the pressure chambers; and electrode parts configured to drive the pressure generating unit, the electrode parts including (i) electrodes formed on inner surfaces of the groove parts, (ii) smoothed films that are formed on surfaces of the electrodes by a coating method, are made of an inorganic material and have an average surface roughness of 0.6 μm or less, and (iii) electrode protection films that are formed on surfaces of the smoothed films to have a thickness of 1.0 μm or more and are made of an inorganic material.

2. An inkjet head comprising:

a substrate in which a plurality of groove parts are provided in parallel, open end sides of the respective groove parts communicating with pressure chambers;

a nozzle plate which is bonded to open end faces of the pressure chambers by an adhesive, and includes nozzles for ejecting ink, each communicating with a respective one of the pressure chambers;

a pressure generating unit configured to generate pressure in the pressure chambers to eject the ink through the nozzles;

an ink supply unit configured to supply the ink into the pressure chambers; and electrode parts configured to drive the pressure generating unit, the electrode parts including (i) smoothed electrodes that are formed on inner surfaces of the groove parts and have an average surface roughness of 0.6 μm or less, smoothed films being formed on surfaces of the smoothed electrodes by a coating method to have, an average surface roughness of 0.6 μm or less and made of an inorganic material, and (ii) electrode protection films that are formed on surfaces of the smoothed electrodes to have a thickness of 1.0 μm or more and are made of an inorganic material.

3. The inkjet head of claim 2, wherein the smoothed films are formed on surfaces of a plurality of electrode layers.

* * * * *